United States Patent [19]

Wüsthof et al.

[11] Patent Number: 4,807,519

[45] Date of Patent: Feb. 28, 1989

[54] PISTON MACHINE WITH CHANGEABLE DISPLACEMENT

[75] Inventors: Peter Wüsthof, Lohr am Main, Fed. Rep. of Germany; Sinclair Cunningham, Fife, Scotland

[73] Assignee: Mannesmann Rexroth GmbH, Fed. Rep. of Germany

[21] Appl. No.: 111,019

[22] Filed: Oct. 20, 1987

[30] Foreign Application Priority Data

Oct. 31, 1986 [DE] Fed. Rep. of Germany ..... 3637174
Feb. 27, 1987 [DE] Fed. Rep. of Germany ..... 3706460

[51] Int. Cl.[4] ..... F01B 1/06; F01B 13/06

[52] U.S. Cl. ..... 91/492; 91/497; 91/519

[58] Field of Search ..... 91/491, 492, 497, 519

[56] References Cited

U.S. PATENT DOCUMENTS

| | | | |
|---|---|---|---|
| 3,369,457 | 2/1968 | Guinot | 91/491 X |
| 3,403,599 | 10/1968 | Guinot | 91/491 X |
| 3,593,621 | 7/1971 | Praddaude | 91/492 X |
| 4,259,894 | 4/1981 | Arama et al. | 91/491 X |
| 4,326,450 | 4/1982 | Bacquie | 91/491 X |
| 4,404,896 | 9/1983 | Allart et al. | 91/497 X |

FOREIGN PATENT DOCUMENTS

| | | |
|---|---|---|
| 1453497 | 5/1969 | Fed. Rep. of Germany . |
| 1528489 | 4/1970 | Fed. Rep. of Germany . |
| 1653587 | 5/1972 | Fed. Rep. of Germany . |
| 2417348 | 10/1974 | Fed. Rep. of Germany . |
| 1905455 | 8/1978 | Fed. Rep. of Germany . |
| 2939327 | 4/1981 | Fed. Rep. of Germany . |
| 3041412 | 2/1982 | Fed. Rep. of Germany . |
| 3116826 | 2/1982 | Fed. Rep. of Germany . |
| 3109706 | 9/1986 | Fed. Rep. of Germany . |

*Primary Examiner*—Robert E. Garrett
*Assistant Examiner*—Mark A. Williamson
*Attorney, Agent, or Firm*—Harness, Dickey & Pierce

[57] ABSTRACT

The invention relates to a piston machine comprising a plurality of pistons and changeable piston displacement for varying the torque and speed. The pistons are connected via control bores and distributor passages in the distributor of the machine to a high pressure and low pressure connection. To reduce the displacement a switching valve is provided via which the inactive pistons are connected together via their distributor passages and also possibly subjected to an external very low servo pressure or tank pressure. This reduces the frictional losses, increases the efficiency and avoids flow losses of the valve.

11 Claims, 3 Drawing Sheets

PISTON MACHINE WITH CHANGEABLE DISPLACEMENT

BACKGROUND OF THE INVENTION

The invention relates to a piston machine with changeable displacement according to the preamble of claim 1.

In multi-piston machines the capacity or piston displacement is varied in known manner in that the number of active pistons and cams is influenced (Poclain hydraulics). For changing over the multi-piston engines must be provided with a three-passage distributor which communicates with the pistons. One passage is always connected to the high pressure and a second passage to the low pressure. The third passage is switched via a switching valve. If the third passage is connected to the high pressure the machine has the full displacement. If however the third passage is connected to the low pressure, the displacement is reduced to half, the torque being correspondingly diminished. If however the same delivery volume is furnished by the fluid source the speed of the engine is doubled.

The pistons subjected at half displacement to the low pressure cause high mechanical frictional looses and furnish a starting torque which frequently no longer suffices to start up under load. As is known, the low pressure in closed hydraulic systems can lie in the order of magnitude of 15 to 25 bar and more. The efficiency losses of such machines at half displacement are then relatively high.

The invention is therefore based on the problem of further developing a piston machine with changeable displacement in such a manner that the efficiency is improved and the flow losses reduced.

SUMMARY OF THE INVENTION

This problem is solved with the features of the characterizing clause of claim 1.

Thus, according to the invention the cylinder chambers belonging to the pistons to be disconnected for the displacement reduction are connected via the distributor passages and the directional control valve together and separated from the supply and discharge of the working medium. In contrast, in the prior art the disconnected distributor passages were each connected to the low pressure side, i.e. the working medium discharge, and thus on reversing necessarily connected to the working medium supply. This means that in such a case an additional pressure load occurs in the machine which manifests itself in losses in efficiency. This disadvantage is eliminated according to the invention. The amount of working medium displaced from each disconnected piston is taken up in the revolution of the machine by the counter piston. Furthermore, according to the invention the number of inactive pistons can be subjected to a servo pressure which is substantially lower than the low pressure obtaining in the system. Thus, for the servo pressure 1 to 5 bar are sufficient. The inactive pistons, i.e. the pistons in the idle displacement position, are thus subjected only to the very low servo pressure and cause only minor losses.

A further advantage of the invention resides in that at half displacement the delivery flow for the active pistons is not conducted via the directional control valve but can be supplied directly to the corresponding control bores for the active pistons. In this manner the flow losses caused by the valve are avoided.

On reversal of the direction of rotation of the machine the states and advantages described are retained.

Advantageous further developments of the invention are set forth in the subsidiary claims. Thus, according to the invention the directional control valve is arranged in the distributor of the machine which comprises a servo pressure connection, the slide of the directional control valve being switched over by the servo pressure and through an opening check valve the servo pressure acts on the distributor passages to be connected together.

If in a further embodiment according to the invention distributor passages are connected to the housing or tank and the particular pistons passing through a disconnected displacement portion are held in their lower dead-center position by the blocking means, then said pistons rotate completely free of loss without idle displacement. The displacement work then takes place only in the stroke portions connected to the working pressure.

By combining the control bores leading to the pistons in the distributor in distributor passages arranged in groups, on changing the displacement a ratio of 1:2 can preferably be achieved but other displacement ratios and speed ratios are possible if the control bores are connected to a corresponding number of distributor passages. The directional control valve must always be constructed so that in the particular switching position a predetermined number of pistons can be subjected to the servo pressure.

BRIEF DESCRIPTION OF THE DRAWINGS

Examples of embodiment of the invention will be explained in detail hereinafter with the aid of the drawings, wherein.

DETAILED DESCRIPTION OF THE PREFERRED EMBODIMENTS

Figure 1:
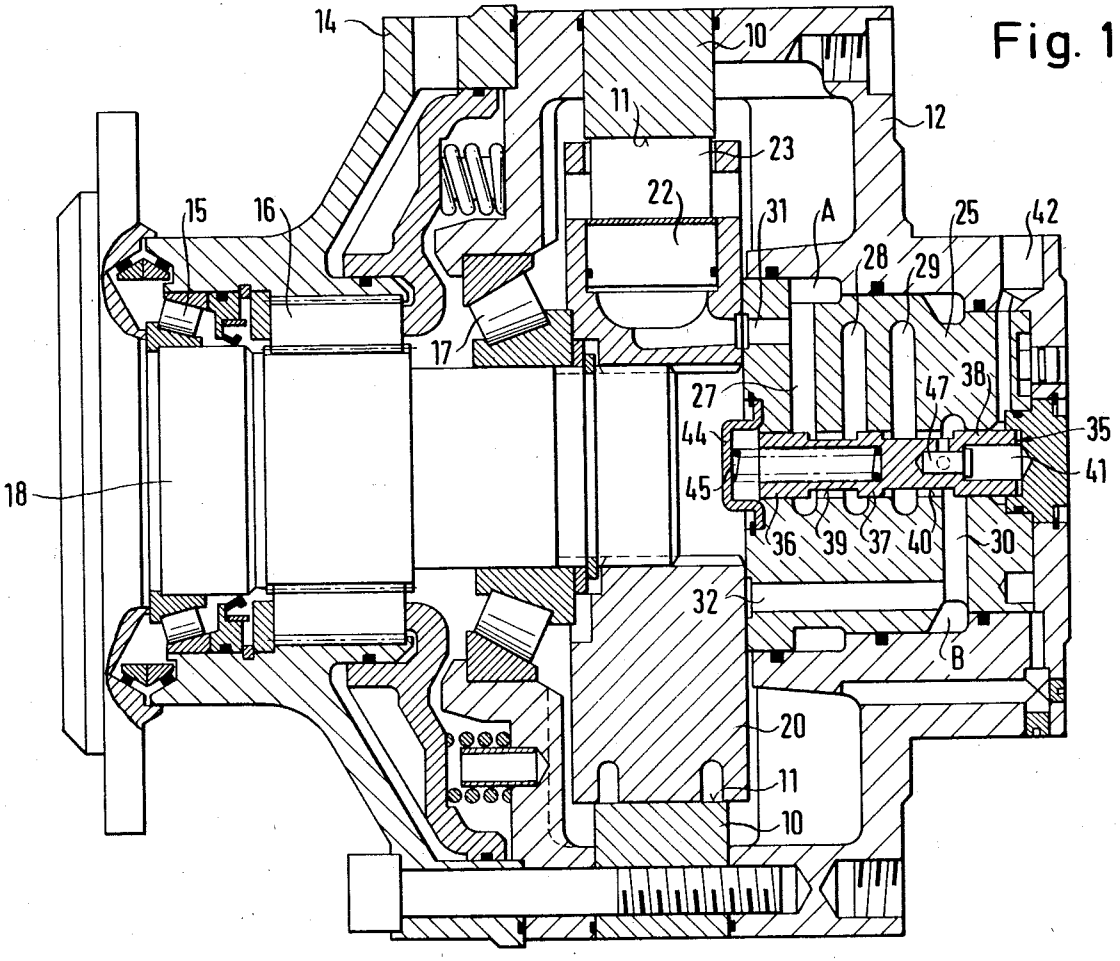
FIG. 1 is an axial section through a multi-diplacement piston machine in a first embodiment.

The piston machine illustrated in FIG. 1 is made in conventional manner and consists of a lift ring 10 on the inner side of which the lift curve 11 is formed. The lift curve 11 is provided for example with six cams. On either side of the lift ring 10 there are housing portions 12 and 14. The housing portion 14 comprises bearings 15, 16 and 17 with which a drive shaft 18 is radially and axially mounted. On the rotating drive shaft 18 a rotor 20 is secured which roter has a number of radial bores 21 open at the outer periphery , each of which receives a piston 22. The section through the machine in the drawings is made such that only one piston 22 is visible. Each piston 22 carries a shoe 23 which slides on the lift curve 11. Eight pistons 22 are for example provided.

Inserted in the housing portion 12 is a distributor 25. In the distributor 25 facing the rotor 20 a plurality of control bores to be described below is provided via which the displacement flow to the pistons is conducted and led off. To this extent the machine corresponds to the usual construction. If the machine is operated as motor, via a high pressure connection A and corresponding control bores fluid is supplied to the pistons which can move outwardly radially under the action of the high pressure, the rotary shaft 18 thereby being driven the inwardly directed movement of the pistons the fluid is forced via corresponding control bores to a low pressure connection B of the machine. The machine can operate just as well as a pump if the drive shaft 18 is driven from outside.

Arranged in the distributor 25 are four distributor passages 27, 28, 29 and 30, each of which communicates with control bores 31 and 32 arranged spaced apart at the periphery of the distributor 25. Since the machine is shown in section in the drawings not all the control bores can be seen. It is apparent from the illustration that the high pressure connection A is connected via the distributor passage 27 to the control bore 31 and the low pressure connection B is connected via the distributor passage 30 to the control bore 32. The high pressure and low pressure connections A and B are connected via the respective distributor passages 27 and 30 in each case to a further control bore which is not shown in the drawings.

The same applies to the distributor passages 28 and 29, each of which also communicates with two control bores which open out on the rotor side at the distributor 25 and are not visible.

In an eccentric bore of the distributor 25 a slide 35 is disposed which consists of three piston portions 36, 37, 38 and two annular grooves 39 and 40 formed between the piston portions. A bore chamber 41 can be connected via a servo pressure connection 42 to an external servo fluid source which is not shown. When no servo pressure is applied to the connection 42 the slide 35 is pressed by a spring 45 bearing on a cover 44 of the distributor 25 into the position illustrated in which the distributor passages 27 and 28 are connected together and the distributor passages 29 and 30 are also connected together. In this switch position of the slide 35 the distributor passage 28 is thus also subjected to high pressure via the annular groove 39 and the control bores connected to said passage whilst via the annular groove 40 the distributor passage 29 and the control bores connected theret are connected via the distributor passage 30 to the low pressure connection B. In this switching position all the control bores are thus connected to high pressure or low pressure and the machine has the full displacement and consequently the full torque.

If a change is to be made to half displacement the connection 42 is subjected to the servo pressure. Due to the pressure buildup in the chamber 41 the slide 35 is switched over against the force of the spring 45 and as a result the piston portion 38 shuts off the distributor passage 30 and the piston portion 27 shuts off the distributor passage 27. Provided in the slide 35 is a check valve 47 which opens in the flow direction from chamber 41 to the annular groove 40. As a result, the servo pressure can pass from the chamber 41 via the open check valve 47 into the annular groove 40 and from the latter enter the two middle distributor passages 28 and 29. The pistons communicating via the associated control bores with said distributor passages 28 and 29 are thus subjected to servo pressure and consequently move in an idle displacement position.

It is obvious that in this switch position of the slide 35 the high pressure flow passes directly from the connection A to the control bores and the low pressure flows directly to the connection B without the displacement flow traversing the directional control valve 25, thus avoiding corresponding flow losses when switching to half displacement.

If the pistons disconnected to reduce the displacement are not to be connected to the servo pressure then the check valve 47 in the directional control valve slide 35 can be dispensed with. In this case, on switching over the directional control valve the distributor passages 28 and 29 are merely connected together and disconnected from the connections A and B. This also permits a reduction of the displacement of the machine without appreciably impairing the efficiency.

Figure 2:
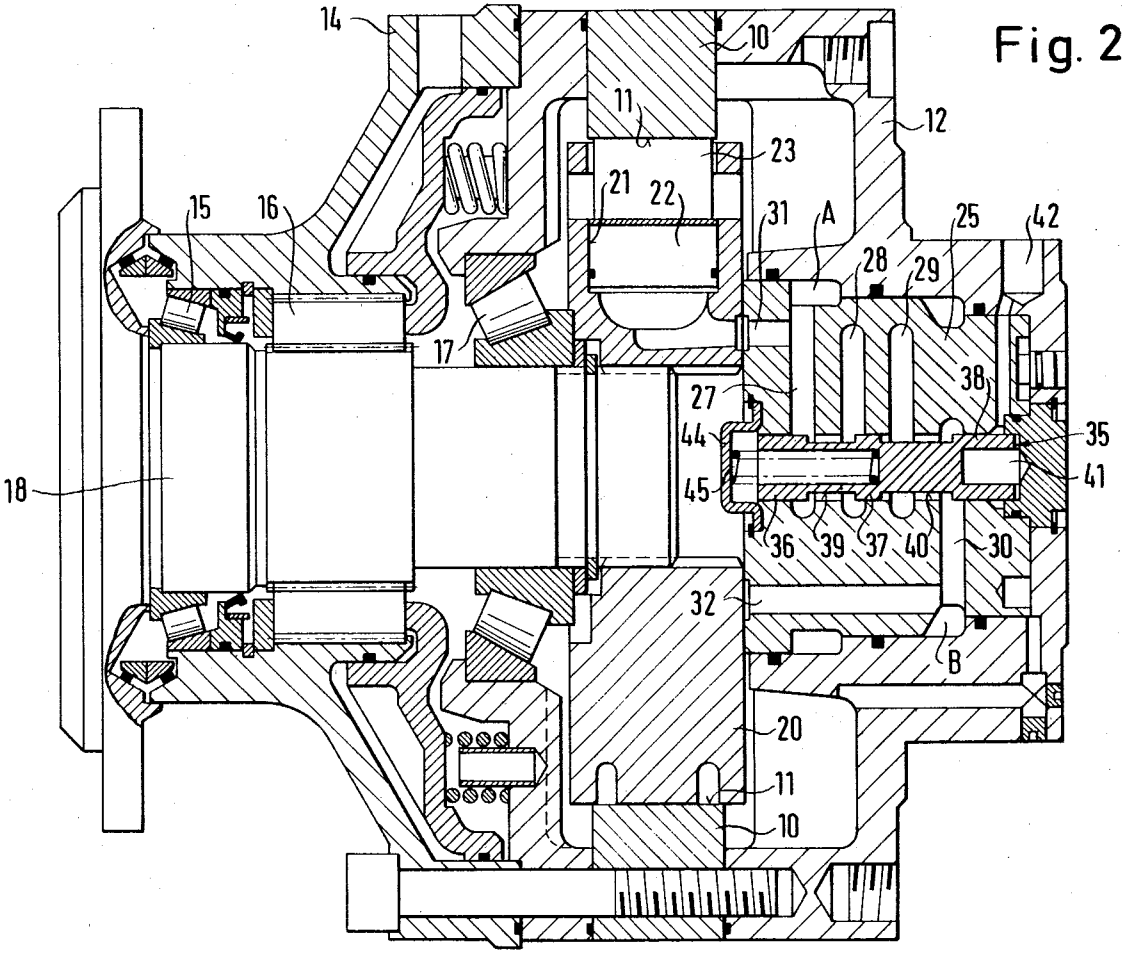
FIG. 2 is an axial section through a multi-displacement piston machine in a second embodiment and FIG. 3 is a partial section of FIG. 2 to a greater scale.
Figure 3:
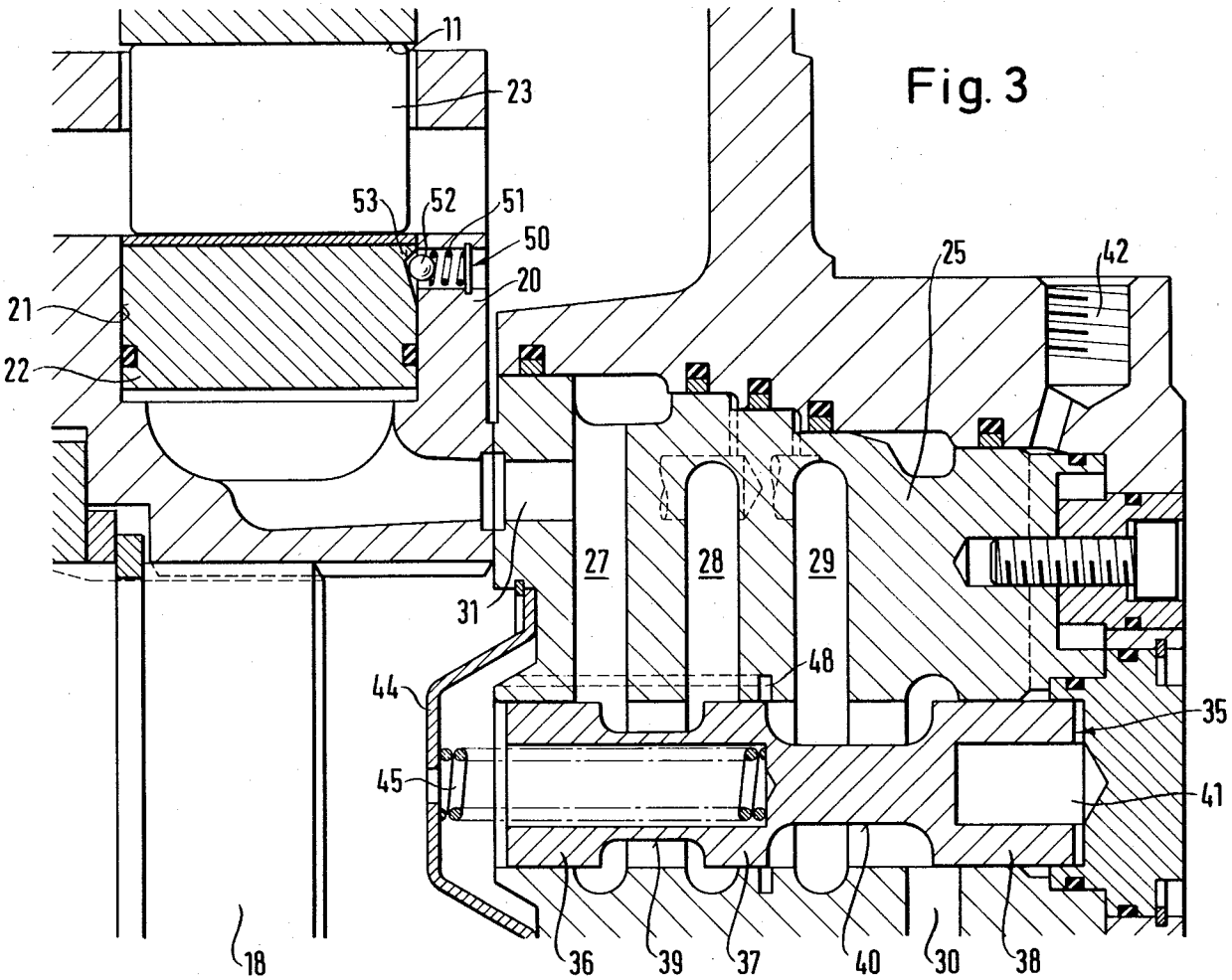

The machine illustrated in FIG. 2 corresponds completely to the embodiment of FIG. 1 with the following modification: a passage 48 opens into the bore for the slide 35 between the distributor passages 28 and 29. The passage 48 is connected to the housing interior, i.e. is subjected to the housing or tank pressure. When the slide 35 is switched over the distributor passages 28 and 29 are thus connected via the passage 48 to the housing interior.

In addition, for each piston 22 in the cylinder block 20 a mechanical blocking means 50 is provided and is arranged in the bore receiving said piston 22 in such a manner that the latter is held by the blocking means 50 fixed in the lower dead-center position.

The mechanical blocking means 50 consists of a ball 52 which is subjected to the action of a spring 51 and engages in a recess 53 of the piston 22.

Each piston which thus executes a displacement or stroke portion defined by the distributor passages 28 and 29 connected to each other and to the tank pressure is thus held in its lower dead-center position by the blocking means 50 so that it revolves loss-free without idle displacement. If the piston in a following displacement portion is again subjected to pressure via the distributor passage connected to the fluid source said piston 22 is automatically releasable from the blocking means 50 so that in the displacement portions connected to the working pressure displacement work of the piston can take place.

We claim:

1. Piston machine having a plurality of pistons with changeable piston displacement comprising a distributor in which control bores leading to the pistons and distributor passages connected to the control bores are provided, via which the pistons can be connected to a high pressure or a low pressure connection, and a flow control valve for displacement changing, said flow control valve being actuated by servo pressure, actuation of said flow control valve being effective to vary the number of effective pistons, characterized in that the displacement is reduced by means of the flow control valve disconnecting a number of said distributor passages from the high pressure and low pressure connections and connecting said number of said distributor passages from the high pressure and low pressure connections and connecting said number of distributor passages to each other and to servo pressure.

2. Piston machine according to claim 1, characterized in that the flow control valve comprises a check valve via which the servo pressure can be supplied to the distributor passages for the inactive pistons.

3. Piston machine according to claim 1, characterized in that the flow control valve comprises a spring-loaded slide with switch positions.

4. Piston machine according to claim 3, characterized in that a check valve is disposed in the slide of the flow control valve for connecting the connected distributor passages to a servo pressure.

5. Piston machine according to claim 1, characterized in that the slide of the flow control valve is disposed in the distributor of the machine.

6. Piston machine according to claim 1, characterized in that to change the displacement in the ratio 1:2 four distributor passages are provided which are each connected to the same number of control bores, that at full displacement two distributor passages are connected to the high pressure connection and two distributor passages to the low pressure connection and at half displacement one distributor passage is connected to the high pressure connection and one to the low pressure connection and the remaining two distributor passages are connected together.

7. Piston machine according to claim 6, characterized in that in the distributor four distributor passages are arranged spaced apart axially and the slide comprises two annular grooves , that at full displacement each outer distributor passage is connected via a respective annular groove to the adjacent distributor passages and at half displacement the two center distributor passages are connected together.

8. Piston machine according to claim 7, characterized in that the outer distributor passages are connected to the high pressure connection and the low pressure connection.

9. Piston machine according to claim 1, characterized in that the disconnectable distributor passages are subjected to the housing or tank pressure and the pistons can be fixed by a locking means in their lower dead-center position in the cylinder block.

10. Piston machine according to claim 9, characterized in that the blocking means is automatically releasable under pressure.

11. Piston machine according to claim 10, characterized in that the blocking means consists of a ball which is subjected to the action of a spring and engages in a recess in the piston.

* * * * *